US006712932B2

(12) United States Patent
Büchsel et al.

(10) Patent No.: US 6,712,932 B2
(45) Date of Patent: Mar. 30, 2004

(54) METHOD OF PRODUCING SELF-CLEANING AND NON-ADHESIVE PAPER OR PAPER-LIKE MATERIAL

(75) Inventors: Martin Büchsel, Grensbach (DE); Manfred Kaussen, Ottersweier (DE); Sabine Schroft, Baden-Baden (DE)

(73) Assignee: Papierfabrik Schoeller & Hoesch GmbH & Co. KG, Gernsbach (DE)

( * ) Notice: Subject to any disclaimer, the term of this patent is extended or adjusted under 35 U.S.C. 154(b) by 0 days.

(21) Appl. No.: 10/073,096

(22) Filed: Feb. 12, 2002

(65) Prior Publication Data

US 2002/0170690 A1 Nov. 21, 2002

(30) Foreign Application Priority Data

Feb. 13, 2001 (DE) ..... 101 06 494

(51) Int. Cl.[7] ..... D21H 27/00

(52) U.S. Cl. ..... 162/135; 162/145; 162/146; 162/158; 162/181.1; 428/141; 428/143; 428/144; 428/156; 428/220; 428/323; 428/332

(58) Field of Search ..... 162/135, 181.1, 162/146, 145, 158; 428/141, 143, 144, 156, 220, 323, 332

(56) References Cited

U.S. PATENT DOCUMENTS 3,354,022 A 11/1967 Dettre et al.
4,859,804 A * 8/1989 Hata et al. ..... 174/25 R
5,707,740 A * 1/1998 Goodwin ..... 428/410
5,776,619 A * 7/1998 Shanton ..... 428/511
5,888,683 A * 3/1999 Gula et al. ..... 430/22
5,968,695 A * 10/1999 Gula et al. ..... 430/56
5,989,378 A * 11/1999 Liu et al. ..... 156/241
6,149,723 A * 11/2000 Pruett et al. ..... 106/486
6,218,059 B1 * 4/2001 Aylward et al. ..... 430/11
6,242,047 B1 * 6/2001 Johnson et al. ..... 427/361
6,332,953 B1 * 12/2001 Singh et al. ..... 162/134
6,413,591 B1 * 7/2002 Dettling et al. ..... 427/462
6,468,133 B1 * 10/2002 Dettling et al. ..... 451/28

FOREIGN PATENT DOCUMENTS

EP 0 772 514 B1 5/1997

OTHER PUBLICATIONS

"Elektronenmikroskopie" by Flegler et al., 195 Spektrum Akademischer Verlag Heidelberg.

* cited by examiner

*Primary Examiner*—Peter Chin
(74) *Attorney, Agent, or Firm*—Pennie & Edmonds LLP

(57) ABSTRACT

Described is a micro-structured paper or paper-like material having a self-cleaning and/or non-adhesive effect whereby the paper or paper-like material is hydrophobic across the entire cross-section of the material and which is micro-structured in such a way that the surface is provided with elevations and depressions whereby the distance between the elevations ranges from 0.04 to 100 microns and the height of the elevations ranges from 0.04 to 100 microns, and whereby the paper or paper-like material is characterized in that it contains particles having the size of 0.04 to 50 microns that are bound to the paper or paper-like material by means of a binder, and whereby the paper or paper-like material is hydrophobic across the entire cross section of the material, as well as a method for the production thereof.

22 Claims, No Drawings

METHOD OF PRODUCING SELF-CLEANING AND NON-ADHESIVE PAPER OR PAPER-LIKE MATERIAL

DESCRIPTION

The present invention relates a method of producing self-cleaning and non-adhesive or paper-like material.

Numerous methods are described in literature to achieve water-repelling, oil-repelling, and dirt-repelling qualities, which allows self-cleaning as well among other things. Common in these methods is the fact that a highly smooth surface is finished in most cases in a highly hydrophobic manner. However, it has been shown that the effect is either only temporarily or developed inadequately strong for industrial use.

EP-A-0 772 514 discloses that aside from a highly hydrophobic finish, an additional microstructure contributes to the distinct support for the qualities described above. The phenomenon has been observed and described in nature for plants like nasturtium or more highly developed in lotus plants. Accordingly, the creation of artificial surface structures consisting of elevations and depressions with distances between the elevations ranging from 5–200 microns, preferably 10–100 microns, and the height of the elevation ranging from 50–100 microns, preferably 110–50 microns, whereby the elevations are made of hydrophobic polymers, which contributes additionally that items having such artificial surfaces may be given qualities of this type.

However, paper or paper-like material has in general a rather random and disorderly structure that is typically not smooth but has a specific macrostructure, which has as a consequence that a specific development of the above-mentioned microstructure will be impossible.

In particular, the inventors of the present invention have discovered during an attempt to use the method described in EP-A-0 772 514 for the development of a hydrophobic surface structure on paper that the achievable effect is inadequate for commercial application. In particular, fiber swelling occurs in paper that is treated according to the method described in EP-A-0 772 514 upon contact with water, which causes a change in the microstructure. In addition, the inventors of the present invention have observed penetration of water through paper that has been treated in such a manner, which causes the dirt dissolved in water to enter into the paper or even travel completely through the paper thereby.

It was therefore that much more surprising that the inventors of the present invention were from the start successful to produce paper or paper-like material having a non-adhesive and/or self-cleaning effect whereby non-adhesive and/or self-cleaning qualities are durable.

The object of the first aspect of the present invention is thereby a micro-structured paper or paper-like material having a self-cleaning and/or non-adhesive effect whereby the paper or paper-like material is hydrophobic through the entire cross-section of the material and which is micro-structured in such a way that the surface is provided with elevations and depressions whereby the distance between the elevations ranges from 0.04 to 100 microns and the height of the elevations ranges from 0.04 to 100 microns, and whereby the paper or paper-like material is characterized in that it contains particles having the size of 0.04 to 50 microns that are bound to the paper or paper-like material by means of a binder.

With paper and paper-like materials there are understood, according to the invention, materials such as paper, metallized paper, paperboard, cardboard, boxboard and non-wovens, but not textiles.

In a preferred embodiment of the first aspect of the present invention, the distance between the elevations on the surface of a thusly micro-structured paper or paper-like material ranges from 0.04 to 50 microns, particularly preferred in a range of 0.04 to 20 microns. In an additional preferred embodiment, the height of the elevations on the surface of a thusly micro-structured paper or paper-like material ranges from 0.04 to 50 microns, particularly preferred in a range of 0.04 to 20 microns.

It is further preferred according to the invention that the paper or paper-like material is additionally oil repellant. The paper or the paper-like material is thereby, in a preferred manner, oil repellant as well as water repellant [hydrophobic].

According to a preferred embodiment of the first aspect of the present invention, the inventive paper or paper-like material is additionally characterized in that drops of water do not adhere to the surface of the paper or paper-like material but that they roll off durably. This may be determined according to the invention in that a water droplet measuring 20 micro-liters rolls off the surface of the novel paper or paper-like material tilted by 40°, preferably by 10° from the horizontal position, and whereby said water droplet does not adhere to the surface.

Furthermore, the paper or paper-like material in an additional preferred embodiment of the first aspect of the present invention is characterized in that is has a resistance to moisture penetration of more than 10 minutes, preferably more than 30 minutes. This resistance to moisture penetration was determined according to the invention in that the tested paper or paper-like material was placed on top of a sheet of blotting paper whereby a stained water droplet measuring 20 micro-liters was deposited on the surface of the material to be tested and it was left in place on the surface. The underlying blotting paper was visually examined after 10 minutes or correspondingly later. Should there be no staining of the blotting paper be visible, then one can considers the paper to be resistant to moisture penetration for the time tested according to the invention.

Furthermore, the paper or paper-like material is preferably characterized by a resistance to the swelling of fibers. This can be determined according to the invention in that the surface of the paper or paper-like material is visually examined for any swelling of fibers after removing the droplets after 30 minutes from the tested paper surface according to the method described for testing the resistance to moisture penetration. Swelling of fibers may be recognized hereby, for example, by undulations [washboard marks] on the paper or paper-like material. Should these undulations not occur, then the paper is considered to be resistant against swelling of fibers.

In a preferred embodiment of the first aspect of the present invention, the paper or paper-like material has a contact angle with the water greater than 120°, preferably greater than 140°. According to the invention, a water droplet in the amount of 20 micro-liters was placed on the paper or paper-like material to measure the contact angle at room temperature and the contact angle was measured with the aid of a contact measuring device commonly used in the trade, e.g. one from the Kruss Company (Firma Kruss).

Additional properties of the paper or paper-like material, such as basis weight, strength or thickness may be adjusted without difficulties, depending on the desired application, in a traditional manner by those skilled in the art in the appropriate technical field.

The object of an additional aspect of the present invention is a method to manufacture a micro-structured paper or paper-like material that is water-repellant over the entire cross section of the material and having a self-cleaning and/or non-adhesive effect, which is provided with elevations and depressions whereby the distance between the elevations ranges from 0.04 to 100 microns and the height of the elevations ranges from 0.04 to 100 microns as well and whereby the method is characterized in that particles of a size of 0.04 to 50 microns are added to the fibers of the paper or paper-like material and said particles are fixed to the fibers by means of a binder together with the use of a water-repelling agent in the scope of a wet-laying method.

It is basically insignificant for the method in the invention as to which one of the available wet-laying methods is used. Thereby, it could be a method using a papermaking machine having an endless [Fourdrinier] wire, a forming vat, or an oblique wire. The papermaking machine may be equipped with a single or multiple head box. Furthermore, the papermaking machine may be equipped with a flow-through drying device, a contact drying device and/or a non-contact drying device. In case of non-contact drying, it could be UV drying or IR drying.

In a preferred embodiment version, the employed fibers are fibers known to those skilled in the art in the specific technical field such as natural fibers or synthetic fibers, e.g. natural fibers from the wood of coniferous or deciduous trees, whereby the cellulosic fibers have a fiber diameter of 2 to 50 microns. In case of the added use of synthetic fibers, the synthetic fibers could be made of polyproylene (PP), polyvinyl acetate, polythethylene (PE) or polylactic acid (PLA) or bi-component fibers made of polypropylene, polyethylene (PE), such as high-density polyethylene, polyvinyl acetate, and such as polyethyl vinyl acetate and/or polylactic acid.

In an additional preferred embodiment, the employed fibers may be the kind whose elevations were formed in the required sizes with the use of suitable polymers and by grafting them to the basic fibers in a manner known to those skilled in the art. For example, the grafting of suitable polymers may be performed by "chemical grafting." Furthermore, filled synthetic fibers can be used, which are provided with a micro-structured surface according to the definition above, by incorporating fillers instead of grafted fibers. Fibers made of micro-porous polymers may be used as well, such as Accurel-Fasern of the Acordis Company (Firma Acordis).

In a surprising way, it was discovered according to the invention that on paper and paper-like material the desired microstructure may be formed on the paper surface and over the cross section of the material, according to the above-mentioned embodiments, by applying particles in a size of 0.04 to 50 microns.

Useable particles in the invention are particles whose size range preferably between 0.04 and 50 microns, particularly between 0.08 and 30 microns. Nevertheless, particles of the same type having different particle sizes, or particles of different type having the same particle size, and particles of different type and having different particle size may be used in combination.

According to the invention, the particles may be added alternatively during sheet forming across the pulp slurry or additionally at another location of the papermaking machine, for instance across the spray beam or the size press.

In a preferred embodiment, the particles may be added directly to the fiber pulp slurry, for example. They can be applied in this way at adequate solubility or corresponding dispersibility in the head box and possibly with the additional use of a deflocculation agent and/or a retention agent.

Hydrophilic particles concentrate on one side of the paper web during adding to the pulp based on the dewatering process by the wire.

Hydrophobic particles are usually used in form of a dispersing agent containing a surfactant. Hydrophobic particles concentrate surprisingly on one side of the paper web during adding to the pulp based on the dewatering process by the wire.

In an additional preferred embodiment, the particles may be deposited onto the paper web alternatively or additionally through the feed of the head box and/or by spreader or by a roller coating method, e.g. by size press coating.

According to the invention, binders known to the papermaker, e.g. a latex binder, acrylate binder, and/or styrene binder, and/or a pulp-sizing agent are used to bind or fix the particles to the fibers.

According to the invention, binders are generally added at an amount of 1 to 20% by weight of the paper, preferably at an amount of 2 to 15%.

According to the invention, special attention has to be paid so that the desired surface structure of the paper or paper-like material is not eliminated by the added use of the binders described above.

Through the selection of the application method, it will also be determined on which side [of the paper] the corresponding microstructure is to be created by the particles.

The particles are usually inorganic compounds such as metal oxides (e.g. aluminum oxide or iron oxide), corundum (this is $\alpha$-aluminum oxide), silicon dioxide, quartz, quartz powder, silica brine; pigments such as $TiO_2$, carbonates and sulfates, preferably calcium sulfate, barium sulfate, silicic acid, china clay or talcum. In a preferred embodiment in the invention, the particles to be used are silicon dioxide, quartz particles or other $SiO_2$-containing solids.

Besides the above-described mineral components, there are also organic particles suitable such as wood (wood powder) or synthetic particles, as for example synthetic pigments or polymer powder, such as Teflon powder. Teflon powder offers the advantage of having an extremely well-developed water repelling and oil repelling effect.

The exact configuration of the surface structure is determined by the size and concentration of the relative particles.

In general, there are particles added in the amount of 5 to 65% and preferably 10 to 50% by weight of the paper or paper-like material.

Furthermore, there exists the possibility to create an individual pattern in microstructure in which different forms of crystallization and microstructures are deliberately superimposed.

For example, particles may be mixed that have different particle sizes and different crystalline forms or crystallization forms, or they may be superimposed on other particles; for example, $SiO_2$-particles may be superimposed on nano-particles, as they are found in silica brine. For example, the nano-particles may be contained in a water-repelling agent and/or an oil-repelling agent or created by a water-repelling agent and/or an oil-repelling agent.

Water-repelling finishing of paper or paper-like materials may be achieved through added use of hydrophobic agents, such as hydrophobic starches, water-insoluble fats, natural waxes, synthetic waxes, e.g. montan wax, white oil, paraffin waxes and their slush, resins, silicones, silanes, siloxanes, phosphoric acid esters, dicarboxylic acid derivatives, partial esters of polyalcohols, citric acid esters, hydroxy alkylized fatty acids and alcohols, paraffin oxides, chromic fatty acid complexes, chromium- and aluminum alkyl phosphates, tin-organic compounds or urea derivatives.

Oil-repelling finishing may be achieved, for example, with the use of fluorinated silanes, fluorinated siloxanes, fluoride carbon compounds, or fluorinated silicones.

According to the invention, water-repelling agents are expediently used in the amounts of 0.5 to 10% by weight of the paper or paper-like material.

Possible is the use of methods based on water, for instance in the form of emulsions or dispersions, as well as methods based on organic solubilizers to achieve a water-repelling and/or an oil repelling finishing.

In a preferred embodiment of the present invention, water-repelling agents and/or oil-repelling agents are used which function and are manufactured according to the sol/gel (colloidal solution/gel) method. This has the special advantage of causing very thin glazing of the surface of the paper or paper-like material so that, in a way, the binding of all particles is guaranteed and a high resistance to moisture penetration is achieved as well. Thereby, one can do without the additional use of binders in a preferred embodiment through the use of silanes, siloxanes, or silicones as water-repelling or possibly oil-repelling agent in their sufficient amounts.

In an additional preferred embodiment of the present invention, the water-repelling finishing of the paper or paper-like material can be improved further whereby hydrophobic fibers are jointly used in manufacturing of paper or paper-like material according to the invention.

Furthermore, there can be possibly used additionally chromium-, aluminum-, or zirconium salts to fix the particles to the fibers apart from the improvement on the hydrophobic effect.

Beneficial for specific applications are all water-repelling and/or oil-repelling agents, which substantially bind to the matrix and thus have no migration behavior—or they cannot volatilize or alter in any other way as, for example, fluorinated and non-fluorinated silanes as well as fluorinated and non-fluorinated siloxanes. In view of these applications, water-repelling and/or oil-repelling agents are employed that have a solubilizer content of less than 10%.

In a preferred embodiment, there is performed in the scope of the inventive method, in addition to the first use of a water-repelling agent and possibly an oil-repelling agent, a second supplementary water-repelling and/or oil-repelling finishing. Special attention has to be paid thereby that existing surface structures are not damaged or destroyed. Said supplementary water-repelling and/or oil-repelling finishing is to include therefore only a few molecule layers of coating material. Spray methods and press methods can be effective alternatives for this reason compared to immersion methods or size-press coating methods.

In an additional preferred embodiment, the paper or paper-like material finished with the inventive surface structure is at first printed in an intermediate step before it is finished to be water-repellant and/or oil-repellant as described above. Water-repelling and/or oil-repelling finishing may be performed, for example, in the printing press after the actual printing, or pre-waterproofed material may be printed with hydrophobic printing ink and the material may subsequently undergo final water-repelling finishing with fluorinated silanes or fluorinated siloxanes.

Achievement of highly non-adhesive qualities is possible for uncoated and coated paper and additionally for all paper-like materials, cardboard and boxboard as well as metallized papers. The finishing leads to high water-, oil-, and dirt repellency, which is expressed as non-adhesive effect. This can be used in the most varied applications, for example on release paper, packing paper—especially for frozen goods, posters and other liquid-repellant papers that are exposed to environmental influences.

EXAMPLES

1. Overlay paper (25 g/m$^2$) manufactured on an oblique wire machine is immersed for 5–10 seconds in a bath of the water-repelling agent Antispread® and it is subsequently air-dried for 10–30 seconds. The paper shows thereafter a wetting angle of approximately 140° and is unwettable to a high degree.

2. Cover paper for a filter (FU-NP24 glazed), 24 g/m$^2$ with filler content of 17–18% and a mean particle size of 2 microns has gold sputtered on it and is subsequently made water-repellant with Antispread®. The measured contact angle amounts to approximately 140°. Between the wire side and the upper surface there are large differences. The side having a good microstructure is the wire side, which shows very low hysteresis. It is substantially unwettable.

3. Paper made on a Fourdrinier machine, having a basis weight of 29 gm$^2$ with a calcium carbonate content of 30% and a mean particle size of 2 microns, is sputtered with gold and made water-repellant according to example 2, and it shows a contact angle between 130° and 140° at almost unnoticeable hysteresis. Drops run off the surface immediately even at a slight tilt angle.

4. Paper made of 70% cellulosic fibers from deciduous trees and 30% cellulosic fibers from conifer trees, and having a calcium carbonate content of 33% and a mean particle size of 2 microns, and which is made water-repellant according to example 2, shows a contact angle greater than 155° at unnoticeable hysteresis between advance contact angle and receding contact angle. Water droplets roll off at the slightest tilt angle even after a longer contact [with the surface].

5. Paper made of 70% cellulosic fibers from deciduous trees and 30% cellulosic fibers from conifer trees having a $SiO_2$ filler content of 50% and a mean particle size of 3 microns, and which is made water-repellant and oil-repellant using Dynasylan VPS 8815, shows a contact angle greater than 143° and an advance contact angle and a receding contact angle of less than 10°, has a resistance to moisture penetration of more than 30 minutes.

6. A paper made of 70% cellulosic fibers from deciduous trees and 30% fibers from conifer trees and having a $SiO_2$ filler content of 20% and a mean particle size of 3 microns, whereby half of them were mixed with the pulp together with the water-repelling agent Dynasylan VPS 8815 in or through the size press, shows a contact angle of greater than 145° and an advance contact angle and a receding contact angle smaller than 10°, has a resistance to moisture penetration of more than 30 minutes.

What is claimed is:

1. A micro-structured paper or paper-like material having a self-cleaning and/or non-adhesive effect wherein the paper or paper-like material is micro-structured in such a way that the surface is provided with elevations and depressions whereby the distance between the elevations ranges from 0.04 to 100 microns and the height of the elevations ranges from 0.04 to 100 microns, wherein the paper or paper-like material contains particles having a size of 0.04 to 50 microns, wherein said particles are bound to said paper or paper-like material by means of a binder, and wherein the paper or paper-like material is hydrophobic across the entire cross-section of the material.

2. The paper or paper-like material of claim 1, wherein said paper or paper-like material is additionally oil repellant.

3. The paper or paper-like material of claim 1, wherein said paper or paper-like material has a contact angle with water greater than 120°.

4. A method to manufacture micro-structured paper or paper-like material that is water-repellant across the entire cross section of the material and having a self-cleaning and/or non-adhesive effect comprising:

providing a paper or paper-like material comprising fibers with elevations and depressions whereby the distance between the elevations ranges from 0.04 to 100 microns and the height of the elevations ranges from 0.04 to 100 microns;

providing particles of a size of 0.04 to 50 microns;

and fixing said particles to the fibers by means of a wet-laying method using a binder together with a water-repelling agent.

5. The method to manufacture micro-structured paper or paper-like material of claim 4, wherein said fibers are cellulosic fibers.

6. The method of claim 4, wherein said fibers comprise synthetic fibers made of polyproylene, polyvinyl acetate, polythethylene or polylactic acid.

7. The method of claim 4 wherein said particles are added in the amount of about 5 to about 65% per basis weight of said paper or paper-like material.

8. The method of claim 4 further comprising adding an oil-repelling agent to the paper or paper-like material.

9. The method of claim 8, wherein said water-repelling agents, oil-repelling agents, or both are added by the colloidal solution/gel method.

10. The method of claim 4, wherein optionally a first oil-repelling agent is added to the paper or paper-like material, and further comprising adding a second supplementary water-repelling finish, a oil-repelling finish, or both.

11. The method according to claim 4, wherein said particles are selected from metal oxides, corundum, silicon dioxide, quartz, quartz powder, silica brine; TiO2, carbonates, sulfates, china, clay or talcum.

12. The method according to claim 4, wherein the binder is selected from latex binders, acrylate binders, styrene binders, or mixtures thereof, or fluorinated silanes, fluorinated or non-fluorinated siloxanes, functionalized or non-functionalized silicone oils, or mixtures thereof.

13. The method claim 4, further comprising an additional step of printing one micro-structured side of said paper or paper-like material.

14. The method according to claim 13, wherein said printing occurs before making said paper or paper-like material water-repellant.

15. A paper or paper-like product comprising said paper or paper-like material according to claim 1, wherein said product is adapted to be release paper, packing paper, cardboard boxes, or posters, such that at least a portion of the paper or paper-like material is on the exterior of the release paper, packing paper, cardboard boxes, or posters.

16. The method of claim 5, wherein said fibers additionally comprise synthetic fibers made of polyproylene, polyvinyl acetate, polythethylene, polylactic acid, or mixture thereof.

17. The method of claim 8, further comprising the step of printing on the paper or paper-like material before adding said oil-repelling agent.

18. A micro-structured paper or paper-like product having a self-cleaning and/or non-adhesive effect comprising:

a paper or paper-like material having a first surface and a second surface, wherein at least the first surface comprises alternating elevations and depressions, whereby the distance between the elevations ranges from 0.04 to 100 microns and the height of the elevations as determined from the depressions ranges from 0.04 to 100 microns;

particles having a size of 0.04 to 50 microns in an amount between about 5% and about 65% by weight of the paper or paper-like material, wherein the particles comprise an hydrophillic inorganic material bound to at least the first surface of the paper or paper-like material by means of a binder in an amount of about 1% to about 20% by weight of the paper and a first water-repelling agent in the amounts of 0.5 to 10% by weight of the paper or paper-like material applied by a wet-laying method;

wherein said paper or paper-like material is hydrophobic across the entire cross-section of the material and exhibiting a contact angle greater than 155° and substantially no hysteresis between advance contact angle and receding contact angle.

19. The paper or paper-like material of claim 18, wherein the distance between the elevations ranges from about 0.4 to about 20 microns, the height of the elevations ranges from about 0.4 to about 20 microns, the particles have a mean size between about 0.08 microns and about 30 microns, and wherein the paper or paper-like material further comprises a second water-repelling agent in an amount between about 0.5% to about 10% by weight of the paper or paper-like material.

20. The paper or paper-like material of claim 18, wherein the paper or paper-like material comprises cellulosic fibers, wherein both the first and the second sides comprise alternating elevations and depressions and the distance between the elevations ranges from about 0.4 to about 20 microns and the height of the elevations ranges from about 0.4 to about 20 microns, and wherein the particles are bound to both the first and the second sides of the paper or paper-like material.

21. The paper or paper-like material of claim 20, wherein the paper or paper-like product farther comprises hydrophobic organic particles having a mean size between about 0.08 microns and about 30 microns bound to at least the second surface by said binder.

22. The paper or paper-like material of claim 20, wherein the paper or paper-like product further comprises fibers of polyproylene, polyvinyl acetate, polythethylene, polylactic acid, polyvinyl acetate, or bi-component fibers made of polypropylene and polyethylene.

* * * * *